US007296795B2

(12) United States Patent
Kawasaki

(10) Patent No.: US 7,296,795 B2
(45) Date of Patent: Nov. 20, 2007

(54) DOUBLE FEED DETECTION METHOD AND DOUBLE FEED DETECTION APPARATUS OF SHEET MATERIALS

(75) Inventor: Takehiko Kawasaki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 25 days.

(21) Appl. No.: 11/536,847

(22) Filed: Sep. 29, 2006

(65) Prior Publication Data

US 2007/0023996 A1 Feb. 1, 2007

Related U.S. Application Data

(62) Division of application No. 10/921,285, filed on Aug. 19, 2004, now Pat. No. 7,152,861, which is a division of application No. 10/656,504, filed on Sep. 8, 2003, now Pat. No. 6,866,263, application No. 11/536,847, filed as application No. PCT/JP03/06999 on Jun. 3, 2003.

(30) Foreign Application Priority Data

Jun. 4, 2002 (JP) ..... 2002-162996
Jun. 4, 2002 (JP) ..... 2002-162997

(51) Int. Cl.
*B65H 7/12* (2006.01)

(52) U.S. Cl. ..... 271/262; 271/263

(58) Field of Classification Search ..... 271/262, 271/263, 265.04
See application file for complete search history.

(56) References Cited

U.S. PATENT DOCUMENTS 3,826,487 A 7/1974 Förster et al. ..... 271/263
4,519,245 A 5/1985 Evans ..... 73/579
4,550,252 A 10/1985 Tee ..... 250/223 R
4,688,423 A 8/1987 Orkosalo ..... 73/159
4,847,638 A 7/1989 Moriyama ..... 346/140 R
4,864,851 A 9/1989 Haughton ..... 73/519
4,866,984 A 9/1989 Houghton ..... 73/159
4,970,895 A 11/1990 Houghton et al. ..... 73/159
4,982,947 A 1/1991 Milne ..... 271/263
4,991,432 A 2/1991 Houghton et al. ..... 73/159
5,136,202 A 8/1992 Carenzo et al. ..... 310/330
5,295,673 A 3/1994 Torisawa et al. ..... 271/11
5,335,043 A 8/1994 Kluger et al. ..... 355/206
5,361,332 A 11/1994 Yoshida et al. ..... 395/114
5,499,807 A 3/1996 Nakamura et al. ..... 271/121
5,533,399 A 7/1996 Gibson et al. ..... 73/579
5,606,113 A 2/1997 Sheen et al. ..... 73/32 A (Continued)

FOREIGN PATENT DOCUMENTS

DE 691 24 776 6/1992

(Continued)

*Primary Examiner*—David H Bollinger
(74) *Attorney, Agent, or Firm*—Fitzpatrick, Cella, Harper & Scinto

(57) ABSTRACT

A double feed detection method for detecting whether sheet materials are double fed or not, which has an external force application member for applying an external force to a sheet material by bringing external force applicator into contact with the sheet material and a detector for detecting the external force applied to the sheet material by bringing itself into contact with the sheet material and determining whether the sheet materials are double fed or not using a signal obtained from the detector.

3 Claims, 12 Drawing Sheets

U.S. PATENT DOCUMENTS

| | | | | |
|---|---|---|---|---|
| 5,934,140 | A | 8/1999 | Jackson et al. | 73/159 |
| 5,988,634 | A | 11/1999 | Elrick et al. | 271/265.04 |
| 6,000,693 | A | 12/1999 | Tranquilla | 271/263 |
| 6,026,681 | A | 2/2000 | Wunderer et al. | 73/159 |
| 6,097,497 | A | 8/2000 | McGraw | 358/1.12 |
| 6,276,776 | B1 | 8/2001 | Umezawa et al. | 347/17 |
| 6,291,829 | B1 | 9/2001 | Allen et al. | 250/559.01 |
| 6,561,509 | B2 | 5/2003 | Kettenmann et al. | 271/263 |
| 6,672,587 | B1 | 1/2004 | Möhringer et al. | 271/259 |
| 6,734,417 | B2 | 5/2004 | Vejtasa | 250/231.13 |

FOREIGN PATENT DOCUMENTS

| | | |
|---|---|---|
| EP | 0 488 316 A1 | 11/1991 |
| JP | 55-22166 | 2/1980 |
| JP | 55-33116 | 3/1980 |
| JP | 57-148231 | 9/1982 |
| JP | 60-236951 | 11/1985 |
| JP | 61-212744 | 9/1986 |
| JP | 61-250794 | 11/1986 |
| JP | 1-127543 | 5/1989 |
| JP | 4-15005 | 2/1992 |
| JP | 4-197944 | 7/1992 |
| JP | 4-251772 | 9/1992 |
| JP | 5-221099 | 8/1993 |
| JP | 7-53095 | 2/1995 |
| JP | 7-137880 | 5/1995 |
| JP | 8-50073 | 2/1996 |
| JP | 8-169592 | 7/1996 |
| JP | 9-40216 | 2/1997 |
| JP | 10-006607 | 1/1998 |
| JP | 10-152245 | 6/1998 |
| JP | 10-315591 | 12/1998 |
| JP | 10-329964 | 12/1998 |
| JP | 11-314443 | 11/1999 |
| JP | 2000-301805 | 10/2000 |
| JP | 2001-328748 | 11/2001 |

DOUBLE FEED DETECTION METHOD AND DOUBLE FEED DETECTION APPARATUS OF SHEET MATERIALS

This application is a divisional of U.S. patent application Ser. No. 10/921,285, filed Aug. 19, 2004 now U.S. Pat No. 7,152,861, which is a divisional of U.S. patent application Ser. No. 10/656,504, filed Sep. 8, 2003 now U.S. Pat. No. 6,866,263.

This application is a continuation of International Application No. PCT/JP03/06999, filed on Jun. 3, 2003, which claims the benefit of Japanese Patent Application Nos. 2002-162996 filed on Jun. 4, 2002, 2002-162997 filed on Jun. 4, 2002.

BACKGROUND OF THE INVENTION

1. Field of the Invention

The present invention relates to a double feed detection method of recording media or documents, and a double feed detection apparatus.

More specifically, the present invention relates to a method for detecting double feed of sheet materials (feeding and conveying two or more sheets of recording media or documents) in a sheet feeding mechanism or a conveying mechanism used in a copier, a printer, a fax, an image reading scanner, or an automatic document feeder.

2. Related Background Art

FIG. 20 shows a configuration of a sheet feeding apparatus (a sheet material feeding apparatus) used in an image reading apparatus that can continuously read several sheets of overlapping documents (sheet materials) for fax or copy. In FIG. 20, reference numeral 9110 denotes a sheet feeding tray; 9101, a batch of documents; 9102, a sensor; 9103, a separation pad; 9105, a securing end; and 9106, a sheet roller.

The sensor 9102 detects that the documents 9101 are set on the sheet feeding tray 9110, and a detection signal is transmitted to a main unit. The separation pad 9103 provided above the sheet roller 9106 separates, one by one, leading ends of the documents 9101 placed in a slanting position on the sheet roller 9106 so as to facilitate sheet feeding.

The separation pad 9103 is pressed downward by a spring 9104, and an upper end of the spring 9104 is secured by the securing end 9105. Specifically, in the sheet feeding apparatus, the leading ends of the documents 9101 that abut against the separation pad 9103 are gradually displaced and separated one by one, due to the weight of the documents, and the separation pad 9103 being placed in the slanting position with respect to an inserting direction of the documents.

The set documents 9101 are fed one by one to a pair of conveying rollers 9107 by the sheet roller 9106. A document leading end detection sensor 9113 notifies the main unit that a leading end of a document reaches the conveying roller 9107. Then, the documents 9101 are successively conveyed. The above example relates to the sheet feeding apparatus used in the image reading apparatus, but a sheet feeding mechanism can be naturally applied to an image forming apparatus such as a copier or a printer.

However, in the above configuration, although the documents (or recording media) are resistant to double feed, whether the fed or conveyed documents are double fed or not cannot be determined (detected), and thus even if the documents are double fed, image reading (or image forming) is performed based on one sheet of document (or one sheet of recording medium) being conveyed. This prevents appropriate image reading or image forming.

SUMMARY OF THE INVENTION

Therefore, the invention has an object to provide a double feed detection method that can detect whether recording media or documents are double fed or not, a double feed detection apparatus, and an image forming apparatus and an image reading apparatus including the double feed detection apparatus.

The invention provides a double feed detection method for detecting whether sheet materials are double fed or not, including the steps of: applying an external force by bringing external force application means into contact with a sheet material; detecting the external force applied to the sheet material by detection means; and determining whether the sheet materials are double fed or not using a signal obtained from the detection means.

The external force is applied by bringing the external force application means into contact with the sheet material from a non-contact state between the external force application means and the sheet material, or the external force is applied to the sheet material from a contact state between the external force application means and the sheet material.

The external force may be applied in a state where the sheet material is standing still, or a state where the sheet material is being conveyed. The state where the sheet material is being conveyed means a state where the sheet material is being moved relative to the external force application means or the detection means.

Further, the invention provides a double feed detection apparatus of sheet materials including: external force application means; and detection means, wherein (1) the external force application means apply an external force by making contact with a sheet material from a non-contact state, or (2) the external force is applied with a contact state between the external force application means and the sheet material being kept. When the external force application means and the detection means are opposed to each other with the sheet material therebetween, a distance between the external force application means and the detection means changes (specifically, becomes short) at the time of the application of the external force. Of course, a range of variation of the distance is larger in the former case (1). In the case (2), the external force is applied in a state where the external force application means and the detection means contacts with the sheet material. The detection means includes means having a detection element exposed or covered.

The sheet material means a recording medium or a document (hereinafter referred to as "recording medium or the like") as mentioned above. The recording medium includes plain paper, glossy paper and an overhead transparency. Double feed detection according to the invention can be effectively applied to an image forming apparatus such as a printer on which one type of recording medium (for example, plain paper) is loaded.

In the invention, double feed of the sheet materials (feeding and conveying two or more sheets of recording media or documents) in a sheet feeding mechanism or a conveying mechanism is detected, and the invention can detect double feed in the following states:

1) a state where two or more sheet materials are conveyed in a completely overlapping manner,
2) a state where two or more sheet materials are conveyed in a displaced and overlapping manner.

The invention can further detect the following state:

3) a state where a sheet material is bent and folded, which looks like two or more sheet materials, is conveyed.

DESCRIPTION OF THE PREFERRED EMBODIMENTS

Now, the invention will be described in detail with reference to the drawings.

Figure 1:
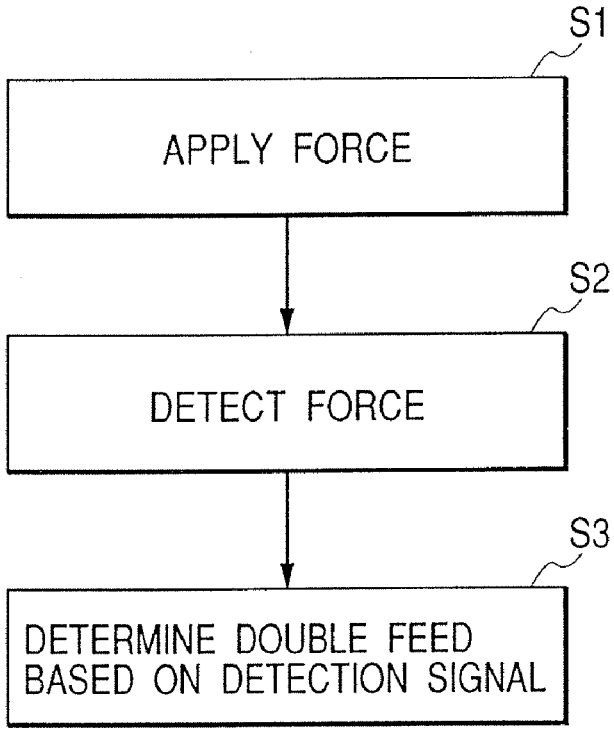
FIG. 1 is a flowchart illustrating the invention.

FIG. 1 illustrates an overview of a double feed detection method of sheet materials according to the invention.

First, external force application means is used to apply a predetermined external force to a sheet material (S1). In this case, the sheet material is held between a first member and a second member such that the external force is applied, and the force is applied from at least one of the members. The sheet material may be held at the same time as the application of the force, or the sheet material may be previously held before the force is applied. Then, the external force is detected by detection means (S2), and a detected signal is used to determine whether the sheet materials are double fed or not (S3).

According to the embodiment, whether the sheet materials are double fed or not can be determined using a difference between a detection signal in a double feed state and a detection signal in a non double feed state.

Figure 2:
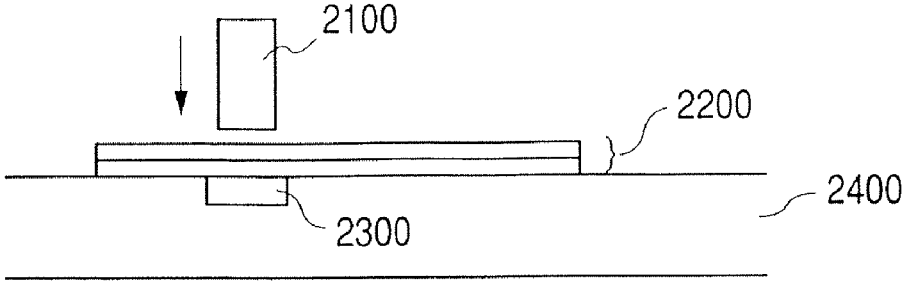
FIG. 2 schematically illustrates an embodiment of the invention.

FIG. 2 schematically shows the embodiment. A sheet material 2200 is placed such that external force application means 2100 makes contact with the sheet material 2200 to apply an external force thereon. The applied force is detected by detection means 2300. The detection means is a unit for detecting a degree of the force applied to the sheet material. Reference numeral 2400 denotes a conveying tray on which the detection means 2300 is provided. When the force is applied, the sheet material is preferably standing still (a state where the sheet material is not being substantially conveyed). This is because, in the detection means 2300, a detection signal may sometimes include a surface state of the sheet material as the sheet material moves. Of course, the sheet material does not have to stand still as long as double feed detection can be performed. If the force is applied to moving sheet materials, a state where the number of overlapping sheet materials changes in a moving direction, such as a state where two or more sheet materials are conveyed in a displaced and overlapping manner, can be detected as a change of an output signal. In the embodiment, an external force except ultrasound is applied to the sheet material.

In the step S1 of applying the external force, the external force application means 2100 may be:

- means having an external force application member that applies the external force to the sheet material based on making contact with the sheet material; or
- means configured so as to blow gas such as air. The external force application member is preferably driven by a drive source. The external force used in the invention may be any force including electromagnetism, heat, expansion/compression of a medium such as gas caused by heat, vibration, or a mechanical force. The drive source may include:
- means that holds the external force application member above the sheet material, and can appropriately drop the member on the sheet material;
- means that drives the external force application member by mechanical or electromagnetic energy (for example, mechanical means such as a spring, or electromagnetic means such as a solenoid or a voice coil); or
- vibration means for vibrating the external force application member (for example, a piezoelectric actuator, an electrostatic actuator, or an electromagnetic vibration generator). A drive source denoted by reference numeral 21 in FIG. 17 uses a spring force of a spring 210.

The external force application means and the sheet material may be brought into contact with each other at the time of the application of the force, or the both are previously brought into contact with each other, and the force is applied from the contact state. When the external force application means and the detection means are opposed to each other with the sheet material therebetween in the former case, a distance between the application means and the detection means changes (becomes shorter) at the time of the application of the force. When the force application means and the force detection means are opposed to each other with the sheet material therebetween, both the force application means and the force detection means may be brought into contact with the sheet material at the time of the application of the force. It is also preferable to displace the sheet material using a displacement member such as a roller or an auxiliary member so as to keep the sheet material under conveyance at a certain distance from the external force application means and the detection means, or bring the sheet material into contact with the means, which effectively stabilizes the detection.

When the force application means applies the force to the sheet material, the sheet material is sometimes slightly deformed (recessed) depending on a degree of the force, thus the force may be applied to an end or the like of the sheet material.

For example, an impact force may be applied to the sheet material by the external force application member, and methods thereof include:

a method in which the external force application member is hit against the sheet material from a distant position; or a method in which an impact force is applied to the sheet material from the external force application member, with an external force application member kept in contact with a sheet material P. Specifically, while the external force is applied by the external force application member anyhow with the member being in contact with the sheet material, the external force application member may be brought into contact with the sheet material only when the external force is applied, or the external force application member may be previously brought into contact with the sheet material before the external force is applied. When the external force application means and the external force detection means are opposed to each other with the sheet material therebetween in the former case, a distance between the external force application means and the external force detection means changes (becomes shorter) at the time of the application of the external force. When the external force application member is previously brought into contact with the sheet material before the external force is applied, the external force is applied with the external force application member and the external force detection means kept in contact with the sheet material.

Alternatively, an external force application member in a vibrating state may be brought into contact with the sheet material to apply vibration to the sheet material instead of the impact force.

Figure 20:
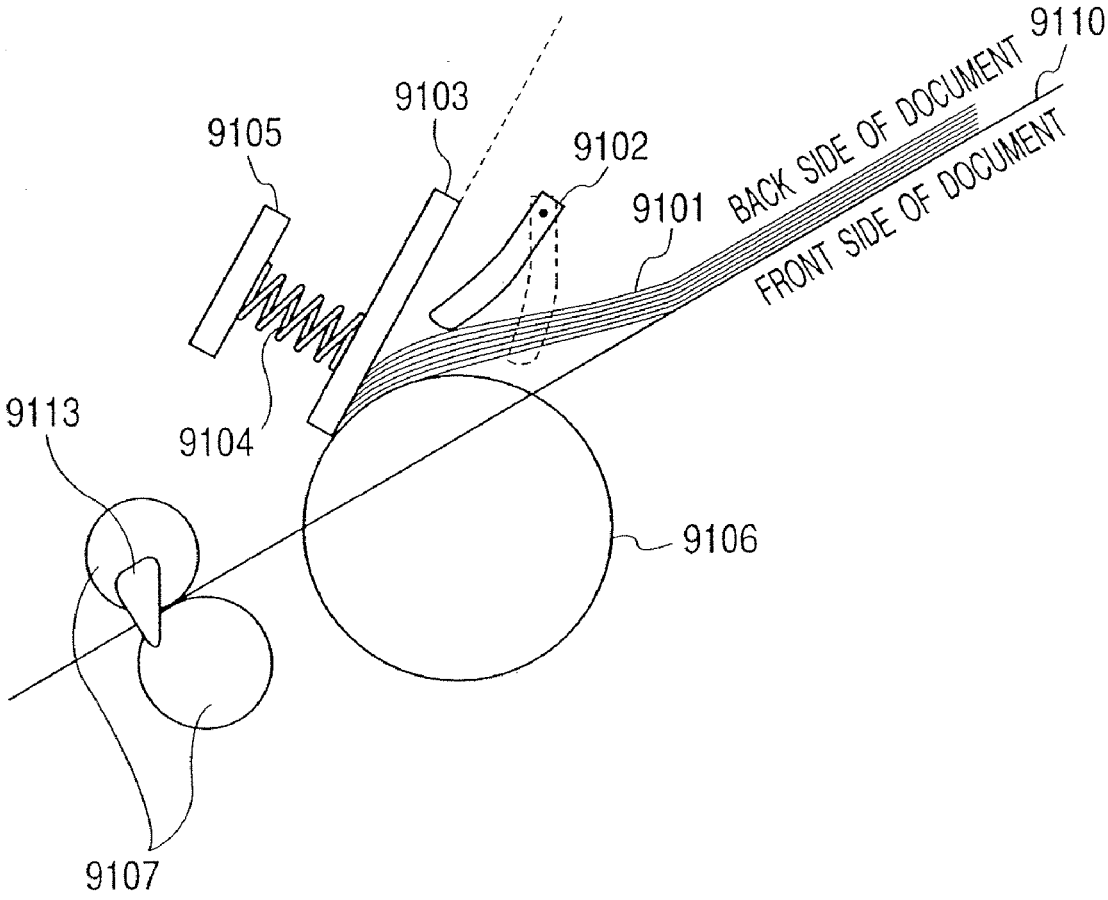
FIG. 20 PRIOR ART
FIG. 20 illustrates a related background art of the invention.

In the application of the force, it is preferable that a leading end detection sensor (for example, 9113 in FIG. 20) is used to detect a leading end of the sheet material, and then a force is applied to a position of the sheet material at a predetermined distance (for example, a standardized value of 29.7 cm when an A4-size sheet is longitudinally conveyed) from a position of the leading end. Depending on the state of double feed and the application position of the force, it may be incorrectly determined that the sheet materials are not double fed, although they are actually double fed, but applying the force to the above described position causes the force to be applied to a reliably overlapping portion, when the sheet materials are double fed. The predetermined distance herein is a standardized value of a recording medium such as paper.

The case where the sheet material is held between the first member and the second member when the force is applied will be described. When the external force application means is placed on an upper side and the conveying tray is placed on a lower side with respect to a thickness direction of the sheet material, the external force application means is the first member, and the conveying tray including the detection means is the second member. Both the first and the second members may be movable, or either of them may be fixed, with respect to the thickness direction of the sheet material.

The sheet material may be held at the same time as the application of the force, or the sheet material may be previously held before the force is applied. Specifically, immediately before the application of the force, the recording medium or the like and impact application means may be in contact or not in contact with each other. When the force is applied to the sheet material, the sheet material and the force application means in either case are in contact with each other.

In FIG. 2, the external force application member 2100 may apply the force to the sheet material 2200 by a weight thereof, or may be brought into contact with the sheet material by the weight thereof before the force is applied. The external force application member 2100 may be pressed against or dropped on the sheet material by a mechanical method or an electromagnetic method. The force may be applied using an elastic body such as a spring.

The external force includes several types of forces as described above, but only one type of external force; or several types of external forces may be used.

When one type of external force is used, information on the sheet material may be obtained by one external force application; or by several times of external force application.

The force may be pulsed, or continuously applied. Several types of forces may be applied.

When several times of external force application is performed (specifically, one type of external force is applied several times, or several types of external forces are applied), a plurality of data can be obtained to increase determination accuracy. In the several times of external force application, impact forces or vibration with different strength may be intermittently applied from one external force application member, or impact forces or vibration with different strength from several external force application members.

When the several times of external force application is performed, the force may be applied to one spot in the sheet material several times, or may be applied to different spots in a surface of the sheet material, or such application methods may be used in combination.

When several sheet materials having the same shape (for example, the standardized size such as A4 size) are loaded on a sheet feeding mechanism or a conveying mechanism, the force may be successively applied to the leading end, a center, and a rear end in the surface of sheet material with the above described size, and double feed with partial overlap of the sheet materials may be detected with high accuracy.

For such several times of external force application, a next external force is preferably applied after motion of the sheet material caused by the applied external force is sufficiently attenuated, or becomes under a predetermined value.

Figure 17:
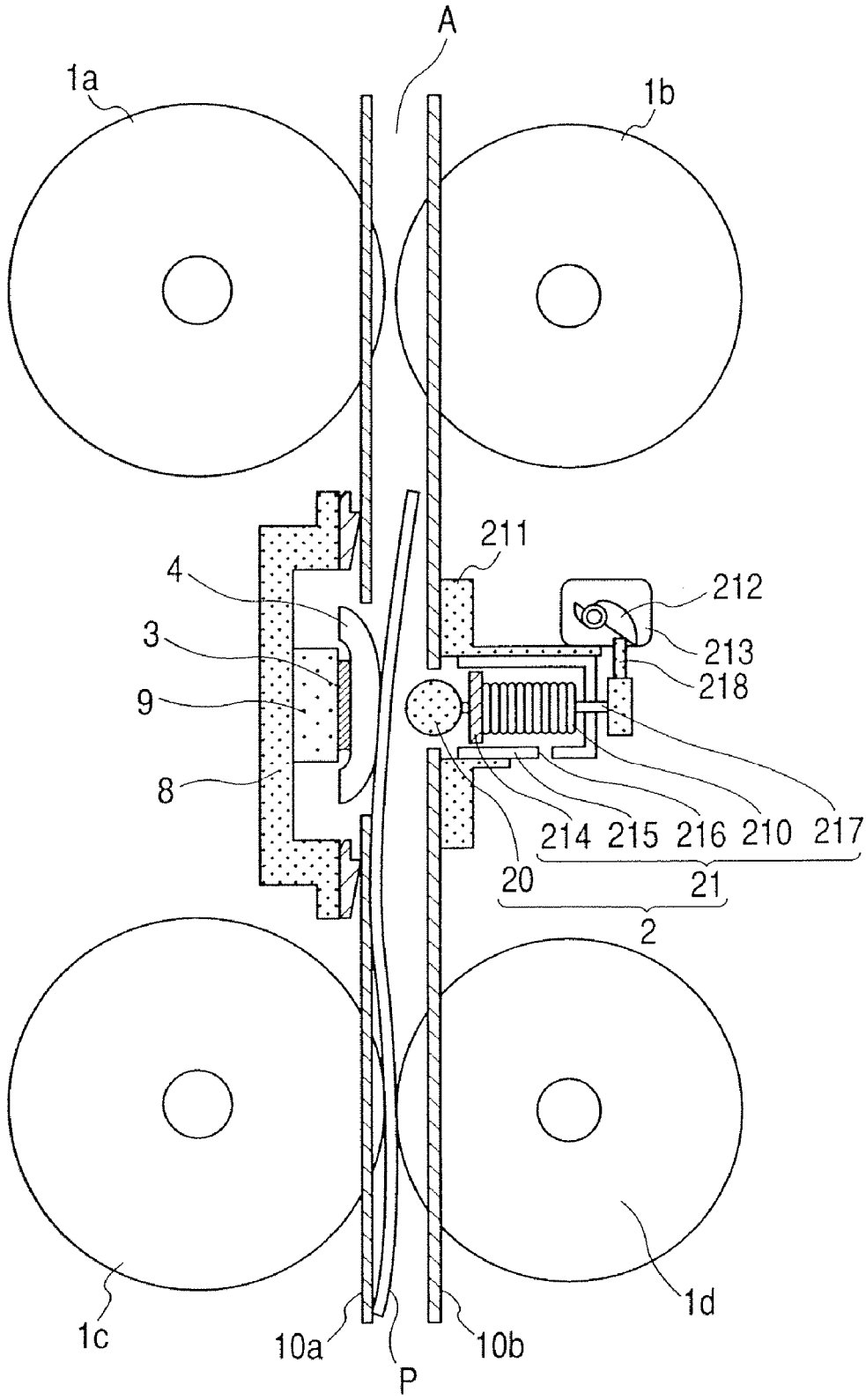
FIG. 17 illustrates an embodiment of the invention.

Such external force application may be performed, for example in FIG. 17, in a state where the sheet material P is being conveyed, or in a state where the conveyed sheet material P is once stopped. When the external force is applied to the sheet material P under conveyance, overlapping information of the sheet materials at several spots in the sheet materials can be easily detected by one of the sensors placed in a conveying system. When the external force is applied to the stopped sheet material P, external force detection means 2 can reduce noise components caused by movement of the sheet material. Such a conveying state is appropriately designed or controlled depending on required information.

Figure 7:
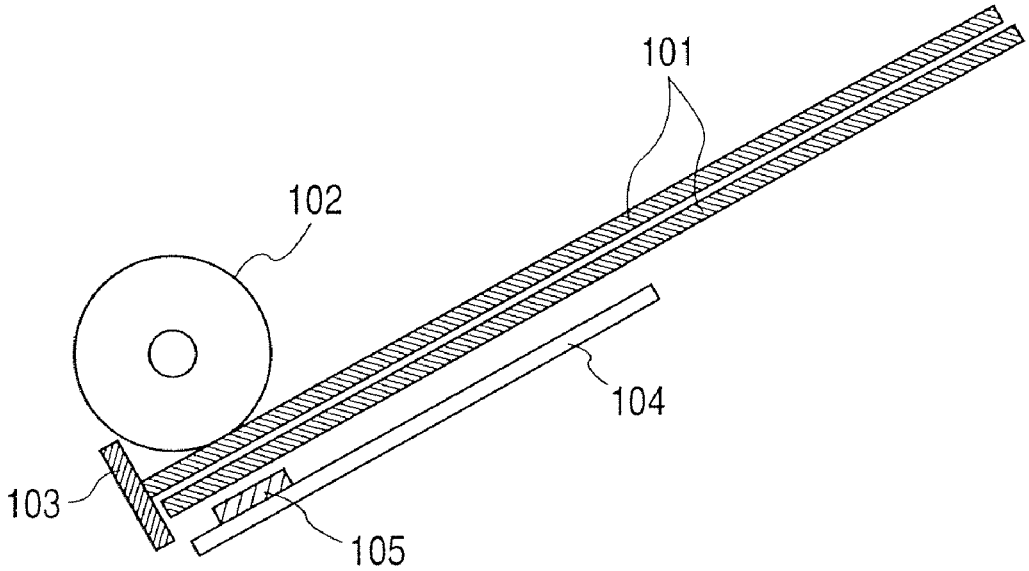
FIG. 7 is a view of a holding guide provided with a piezoelectric sensor according to an embodiment of the invention.

As shown in FIG. 7, when a holding guide 104 is used as the first member, and a pinch roller 102 for conveying a recording medium is used as the second member to hold the sheet material, an external force larger than 1 g/cm$^2$ is preferably applied.

When the first member and the second member hold the recording medium, holding with a force of 1 g/cm$^2$ or larger is preferable.

Accurate double feed detection requires a constant external force applied to the sheet material, and thus some member (hereinafter referred to as "an external force receiving member") is preferably placed in a position opposite the external force application member to receive the external force. When a displacement member (described later in detail) is placed in a position opposite the external force application member, the displacement member may be operated as the external force receiving member (specifically, the displacement member may receive the external force without a separate external force receiving member), and when the displacement member is not placed in a position opposite the external force application member, the external force receiving member may be provided in a position opposite the external force application member. Such an external force receiving member may have a flat or curved contact surface with the sheet material. It is also preferable, in terms of life of an element or the like, that a recess is provided in a position opposite a tip of the external force application means with the sheet material therebetween to disperse the external force concentrated on one point.

Next, the step of detecting the external force applied to the sheet material (S2) and the step of determining whether the sheet materials are double fed or not (S3) will be described.

The detection may be performed using detection means having, for example, a piezoelectric element, and in this case, the external force is detected as a voltage signal. The piezoelectric element as the detection means may be provided on at least one of the first and the second members, and may be provided on both of the members. A possible configuration is such that a recording medium is held between the piezoelectric element on the first member and the second member (specifically, a configuration in which the piezoelectric element receives the force via the sheet material). The force may be applied by the first member itself on which the piezoelectric element is placed, may be applied by the second member, or may be applied by both of them.

A position of the piezoelectric element is not limited as long as the piezoelectric element can detect the force. Thus, for example, a detection unit may be provided in a position opposite the force application means with the sheet material therebetween. Further, the force application means itself may be provided with a member that vibrates on receiving a force (for example, a leaf spring) to determine double feed by changes of the member. It is also possible that the force application means itself include a piezoelectric element as detection means, or the detection means is provided on both the force application means and an opposite position with a sheet therebetween.

On the other hand, the above described external force detection means may contain inorganic materials or organic materials having piezoelectric properties, and may contain, for example, inorganic materials such as PZT (lead zirconate titanate) or PLZT, $BaTiO_3$, PMN—PT ($Pb(Mg_{1/3}Nb_{2/3})O_3$–$PbTiO_3$) or organic piezoelectric materials. When the piezoelectric element is used, the external force is detected as a voltage signal. The external force detection means herein includes means having a detection element itself exposed or covered.

The external force detection means may be placed in any position where the external force can be detected. For example, the external force detection means may be provided in a position opposite the external force application means with the sheet material therebetween, or the external force detection means may be provided on the side of the external force application means. FIG. 17 shows the former example (an example in which the external force detection means 3 is placed in a position opposite the external force application means 2 with the sheet material P therebetween). The shown external force detection means 3 supports a displacement member 4 as an external force receiving member, and the external force detection means 3 detects the external force received by the displacement member. In such a placement, absorption of the applied external force by the sheet material can be efficiently detected. The latter example (an example in which the external force detection means is provided on the side of the external force application means 2) includes placements in which:

an elastic member (not shown) such as a leaf spring is mounted to the external force application means to detect vibration or position changes of the elastic member at the time of the external force application; and the external force application means itself includes the external force detection means. In such placements, reaction of the sheet material against the applied external force can be efficiently detected. The external force detection means may be provided on both the side opposite the external force application means 2 and the side of the external force application means 2 with the sheet material P therebetween. When the external force application means includes the external force detection means, changes of the external force application means itself (for example, resonance frequencies or deformation) may be detected at the time of contact with the sheet material. Further, reverberation after the applied external force is stopped, or attenuation properties thereof may be detected.

The external force detection means may have an one-dimensional array or a two-dimensional array, but if the external force detection means having the two-dimensional array includes a sensor having a length equal to or larger than a width of the sheet material (for example, a recording medium), double feed of the sheet materials displaced in a width direction can be detected. Of course, a plurality of sensors can detect the width or the shape of the recording medium. In such a configuration, double feed can be easily detected even when the sheet materials having different widths or shapes are loaded.

The sheet material double feed detection apparatus according to the invention may include, as shown in FIG. 17, a sheet material displacement means 4 that displaces the sheet material P, which is conveyed through a sheet material conveying passage, to a correct position. The external force may be applied, by the external force application means 3, to the sheet material P displaced by the sheet material displacement means.

Based on the signal (for example, an electric signal) detected in the step S2, the double feed of the sheet material is determined (S3). The determination can be performed based on a table in which signals of double feed of recording media are previously recorded.

In order to obtain the information on the double feed of the sheet material, a person may determine the information based on the detected signal; or sheet material information obtaining means may be provided to automatically obtain the information on the sheet material based on the detection results of the external force detection means 3. The information on the double feed of the sheet material can be output by extracting a voltage, a cycle, a frequency component, a differential value, an integral value, attenuation, the number of peaks, or the like, as characteristic amounts, from waveforms of the detected signal. The sheet material information obtaining means may output the characteristic amount as information determined by checking against a table in which the signals of the sheet material are preciously recorded.

When the signal differs depending on environmental conditions or conveying states, a plurality of tables corresponding to each condition or state may be prepared to perform determination based thereon. Further, determination may be performed together with other means concerning the sheet material (input by a person of a model of set sheet, or a signal from a separate sensor).

Detecting the information on several spots in the sheet material under conveyance allows determination of "continuous double feed" that is a state where leading ends of a plurality of sheet materials are displaced and continuously overlap. Overlapping positions or directions of the sheet materials can be also detected.

Signal processing of the detected signal may be performed, such as subtracting an output signal when the sheet material is not conveyed. A processing circuit for the signal processing may perform signal processing using a first signal received by the external force detection means due to the external force when the sheet material is not held, and using a second signal received by the sensor due to the external force when the sheet material is held.

The sheet material herein means a recording medium (for example, plain paper, glossy paper, coated paper, recycled paper and an overhead transparency), or a document.

"The information on the double feed of the sheet material" means presence or absence of the double feed, the number of double fed sheet materials, overlapping positions of the sheet materials, overlapping directions and the like.

According to the above described sheet material double feed detection apparatus, for example as shown in FIG. 17, sheet material conveying means 1*a*, 1*b*, 1*c*, 1*d* convey the sheet material P, the external force application means 2 applies the external force to the sheet material P, the external force detection means 3 detects the external force, and the information on the sheet material can be obtained based on the detection results (for example, the electric signal).

Figure 18:
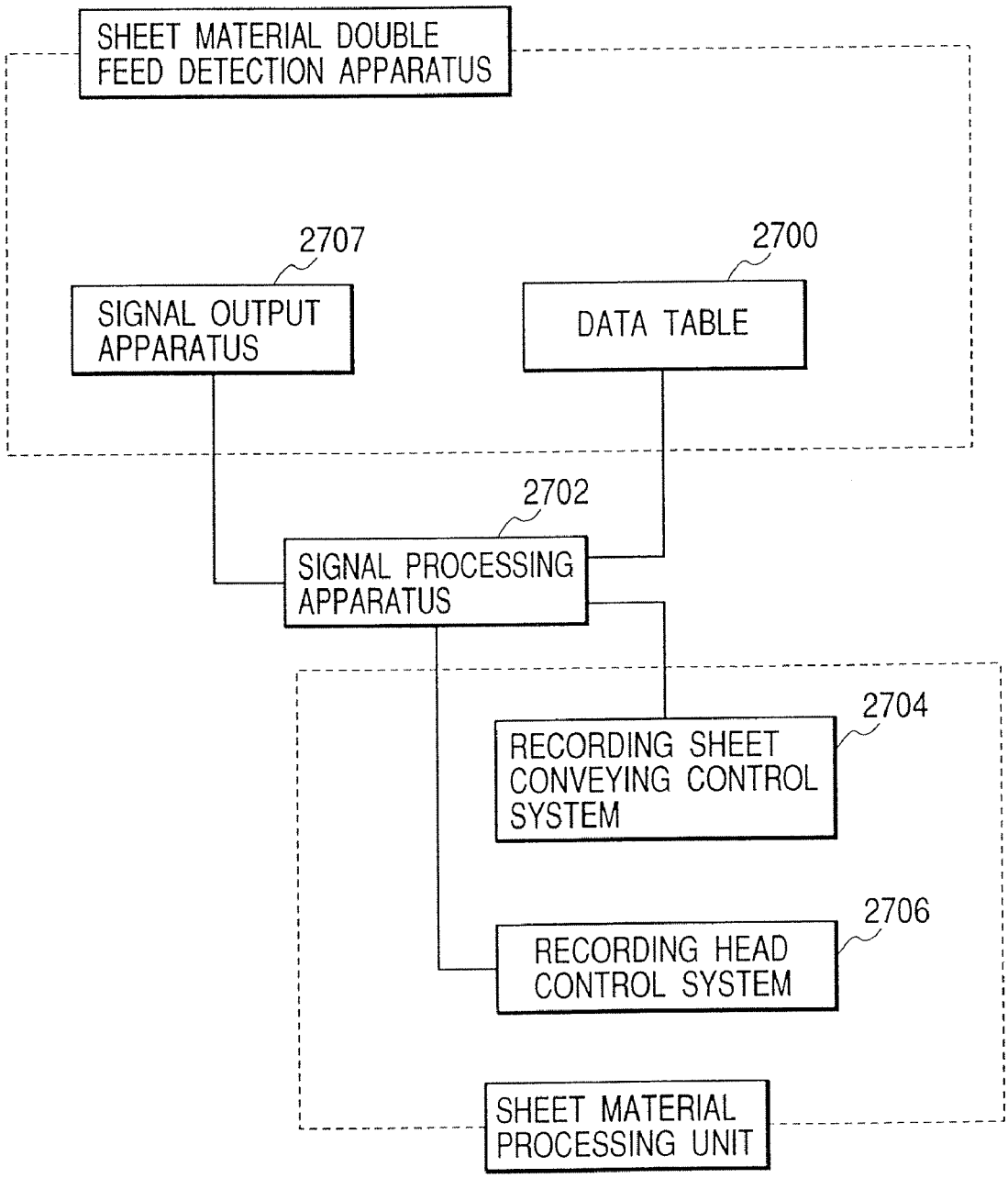
FIG. 18 illustrates an embodiment of the invention.

A sheet material processing apparatus according to the invention includes, as shown in FIG. 18 as an example, the sheet material double feed detection apparatus, and a sheet material processing unit that processes the sheet material considering the detection results of the sheet material double feed detection apparatus.

The sheet material processing unit may include:

an image forming unit that forms an image;

a scanner that reads an image; and other apparatuses. The sheet material processing apparatus may include a copier, a printer, a fax, a scanner for reading an image, or an automatic document feeder.

A sheet conveying guide may be expanded to form a narrow portion. Such a narrow portion is formed to provide the guide with a function of the sheet material displacement means or the external force receiving member.

Then, a CPU preferably changes print modes (for example, adjustment of an image forming condition, adjustment of a conveying condition such as adjustment of a pressing force on a roller used for conveyance, stop of printing, stop of recording media conveyance, generation of a warning signal, control of double-sided print), based on the detection results of the sheet material double feed detection apparatus. The CPU may be provided inside or outside the sheet material processing apparatus, but providing the CPU inside allows sending and receiving of data signals to and from the outside to be omitted.

A signal output apparatus preferably includes an external force application unit that applies the external force to the sheet material, a displacement unit that is placed in a position opposite the external force application unit (with the sheet material therebetween) to control the position of the sheet material, and a signal output unit that outputs a signal caused by the external force. When such a signal output apparatus is configured, an external device is preferably connected to the signal output apparatus, and obtains the information on the sheet material based on the output signal of the signal output unit.

The processing circuit for the signal processing can perform signal processing using a first signal received by the detection means due to the force when the sheet material is not held, and using a second signal received by the sensor due to the force when the sheet material is held.

An example of signal processing when the impact force is applied as the external force will be described.

As the electrical signal from the piezoelectric element, for example, changes of the voltage signal with time can be detected. An impact applied to the sheet material appears as a gradually attenuating signal, and a peak level of the signal, the number of peaks of the signal during attenuation, time that elapses during the attenuation, a degree of change of the peak level due to the attenuation, or the like, differ depending on the presence or absence of the double feed of the recording media, or the number of double fed media.

Specifically, when the impact force is applied, signals detected by the detection means differ depending on the number of sheet materials, and thus whether the sheet materials are double fed or not (a degree of the double feed as required) can be determined based on the peak level and the time between the peaks of the detection signal.

Figure 3:
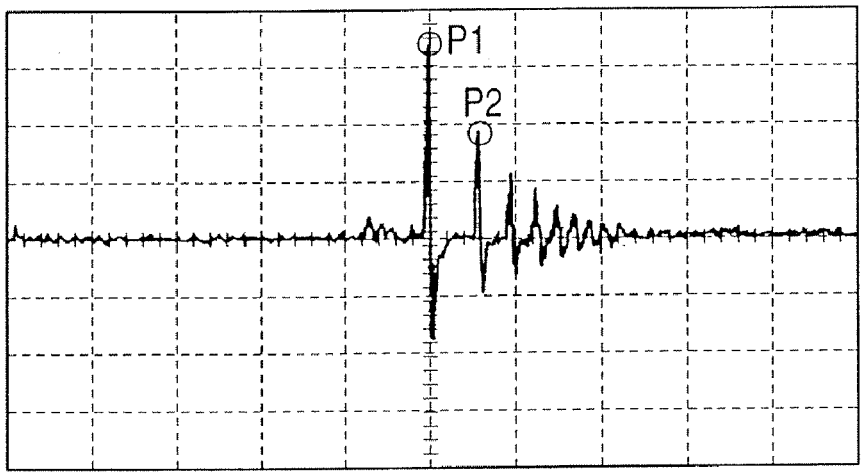
FIG. 3 is a graph of changes with time of an output signal of a piezoelectric element when an impact force is applied to a recording medium.

The inventor uses, as an example, plain paper (CP-250: New Printer Paper manufactured by Canon Inc.), and applies the same impact force to one sheet of paper and two to four sheets of double fed paper, and the degrees of changes of a first peak (P1) after the impact is applied and a succeeding second peak (P2) are calculated as a ratio of a second peak (P2) level to a first peak (P1) level. The values are 0.52 for one sheet (FIG. 3), 0.60 for two sheets (FIG. 4), 0.75 for three sheets (FIG. 5), and 0.78 for four sheets (FIG. 6), and different from each other, which reveals that the double feed detection of the recording media can be performed.

The signal, which is obtained by the detection means used for determining the double feed, and analysis thereof include the following specific examples.

First, the double feed can be determined from a voltage value of a voltage peak generated from the detection means depending on the impact force. The double feed can be also determined from the change of the voltage value with time.

The application of the impact force causes an impact application member 2100 in FIG. 2 to recoil due to a reaction force from the sheet material. Depending on application methods of the impact force, the recoil causes the impact application means 2100 to hit against the sheet material several times. The double feed can be determined from intervals between the voltage peaks generated by the hit due to the several times of recoil. The double feed can be also determined from the voltage value of the voltage peak for each hit. The double feed can be further determined by changes of the interval and the voltage value.

Further, the application of the impact force causes vibration of the impact application member, the sheet material and surroundings. The vibration caused by the impact force can be detected to determine the double feed from frequency components thereof. The double feed can be also determined from strength or vibration attenuation. Similar determination can be performed by detecting sound vibration, which is the caused vibration traveling through the air.

Figure 9:
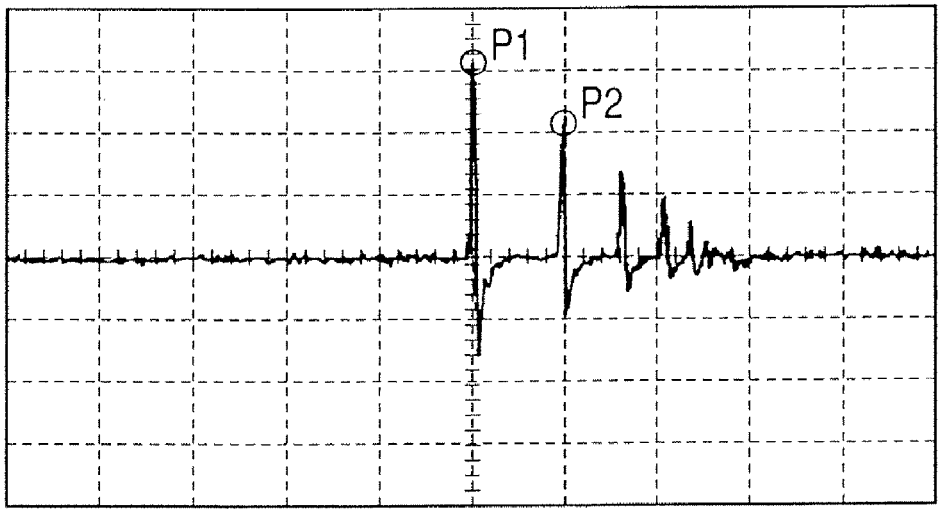
FIG. 9 is a graph of changes with time of an output signal of a piezoelectric element when an impact force is applied to a recording medium.
Figure 10:
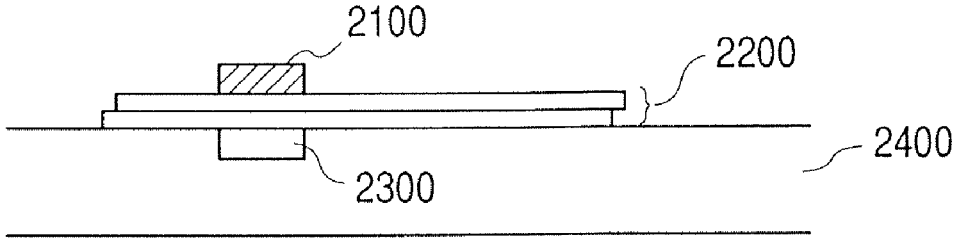
FIG. 10 schematically illustrates the invention.

In FIGS. 3, 4, 5, 6 and 9, the horizontal axes show time (50 ms/div.), and the vertical axes show detection signals (an output voltage of the piezoelectric element as 10 mV/div., but in FIG. 9, 30 mV/div.).

The first peak level successively changes depending on the case of one sheet, and the difference in the double feed states of two to four sheets, and there is a change from 10 mV to 40 mV. The peak herein means the circled spot in the drawings, and the peak level means a value that is obtained by subtracting a value of a voltage signal before the application of the impact force (at this time, the impact force is sufficiently attenuated) from the value of the voltage signal at the peak. Pretreatment of the sheet itself may be performed for obtaining different signals due to the impact. The types of the recording media whose double feed can be determined are not limited to those described above.

Next, an example of signal processing when the vibration is applied as the external force will be described.

It has been shown that when vibration with a predetermined frequency from the vibration generator is applied to one sheet material and a plurality of double fed sheet materials, and motion of the sheet materials by the vibration is detected by a sensor (when the recording medium is held between the vibration generator and the sensor), a peak value differs depending on the presence and absence of the double feed of the recording media or the number of double fed media.

The signal, which is obtained by the detection means used for determining the double feed, and analysis thereof include the following specific examples.

First, the double feed can be determined from the voltage value generated from the detection means depending on the vibration. The double feed can be also determined from the change of the voltage value with time.

Further, the application of the vibration causes vibration of the vibration application member, the sheet material and surroundings. The caused vibration can be detected to determine the double feed from frequency components thereof. Similar determination can be performed by detecting sound vibration, which is the caused vibration traveling through the air.

The double feed can be also determined from strength, vibration attenuation, or a phase shift from an applied signal.

Figure 13:
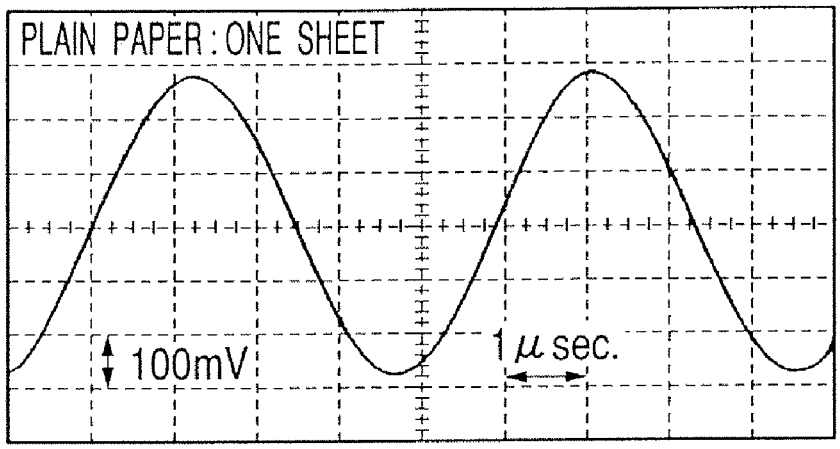
FIG. 13 is a graph of changes with time of vibration when vibration is applied to a recording medium.
Figure 14:
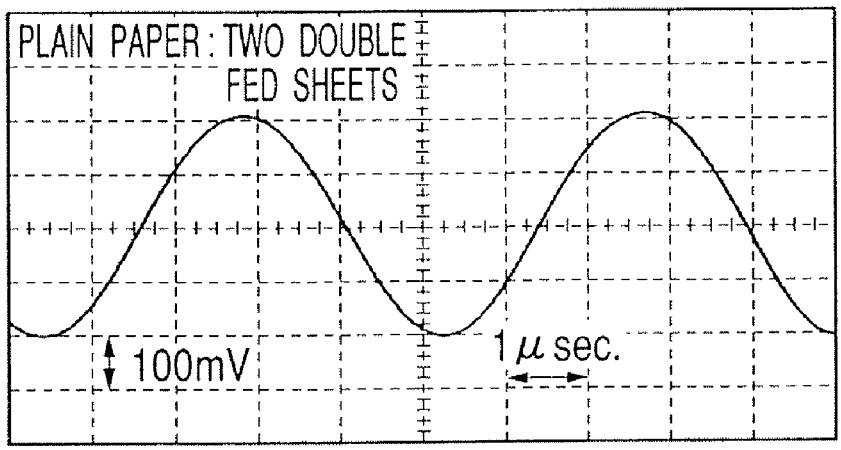
FIG. 14 is a graph of changes with time of vibration when vibration is applied to recording media.
Figure 15:
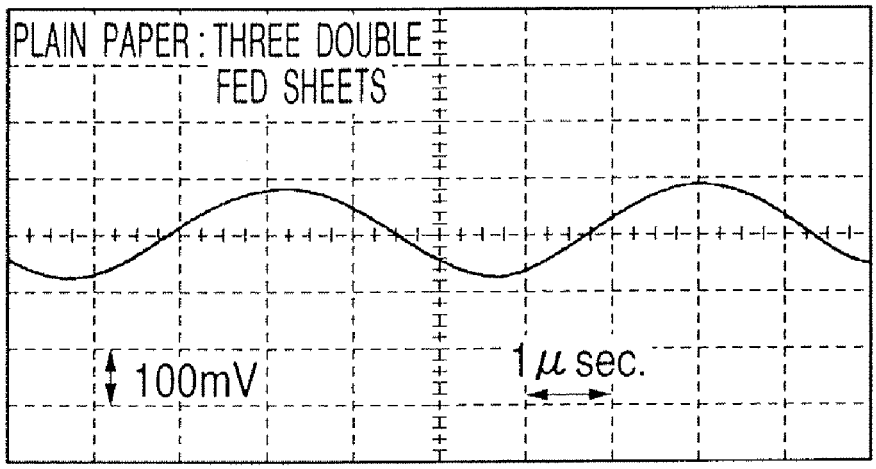
FIG. 15 is a graph of changes with time of vibration when an vibration is applied to recording media.
Figure 16:
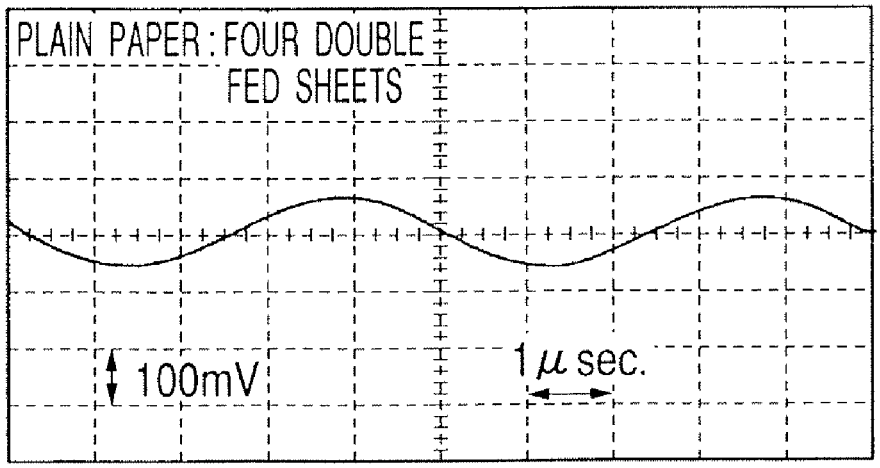
FIG. 16 is a graph of changes with time of vibration when an vibration is applied to recording media.

When plain paper (CP-250: New Printer Paper manufactured by Canon Inc.) is used, and vibration with an amplitude of 25 V and a frequency of 230 KHz is applied to one sheet material and two to four double fed sheet materials, the values are 560 mV for one sheet (FIG. 13), 420 mV for two sheets (FIG. 14), 160 mV for three sheets (FIG. 15), and 120 mV for four sheets (FIG. 16), and different from each other.

Therefore, if a table is prepared in which signals of the double feed of the sheet materials are previously recorded, the double feed detection of the recording medium can be performed based on the table. The determination can be performed automatically or performed from detected signals by a person. The types of the recording media whose double feed can be determined are not limited to those described above. When the signal of the double feed of the recording medium differs depending on types of the media, environmental conditions or conveying states, a plurality of tables corresponding to each condition or state may be prepared to perform determination based thereon. The frequency of the applied vibration may be in a range from some ten KHz to some MHz.

In the case of an image forming apparatus, when the double feed of the sheet materials is detected, a CPU provided inside or outside the image forming apparatus controls (adjusts) to change print modes. The change of the print modes includes, for example, stop of printing, stop of recording media conveyance, adjustment of a conveying condition such as adjustment of a pressing force on a roller used for conveyance, adjustment of an image forming condition, generation of a warning signal. Such control performed by an internal CPU allows sending and receiving of data signals to and from the outside to be omitted. Of course, a person may input the print modes from an external computer. This solves problems caused by the double feed of the recording media. Information on the type of a print sheet and a print mode may be sent to an image forming apparatus (for example, a printer) from a computer connected thereto to change the print modes based on the information. When the double feed is detected in an image reading apparatus, reading may be stropped at that time. When the double feed is detected, the sheet may be simply conveyed to a sheet delivery unit without image forming, or the conveyance itself may be stopped to warn a user.

When the double feed state is detected, the sheet may be delivered without printing. A warning of the double feed may be displayed on the image forming apparatus itself, or on a computer screen of each user via a network. Of course, image forming can be performed while detecting the double feed state to then notify the user.

The invention allows the presence and absence (that is, no sheet material is conveyed) of the sheet material may be detected, besides the presence and absence of the double feed state, thus can be used as means for detecting whether the sheet material is in a desired position.

Embodiment 1

Figure 8:
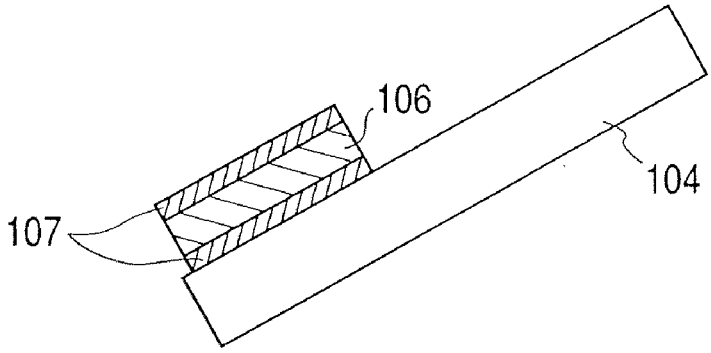
FIG. 8 is an enlarged view of the holding guide provided with the piezoelectric sensor according to the embodiment of FIG. 7.

As an embodiment of the invention, a double feed detection apparatus of recording media used in an inkjet printer will be described with reference to the drawings. Description will be made with reference to FIG. 7. FIG. 7 schematically shows a sheet convey mechanism used for aligning leading ends of print sheets inserted from a tray (not shown) in an inkjet printer. Reference numeral 101 denotes a print sheet; 102, a pinch roller as a holding guide; 103, a guide for aligning the leading ends of the print sheets; 104, a guide for holding the print sheets; and 105, a piezoelectric element. FIG. 7 shows an example in which two print sheets 101 are double fed. FIG. 8 is an enlarged view of the piezoelectric element 105 and the holding guide 104.

The piezoelectric element 105 in this embodiment is PZT (lead zirconate titanate) and vertically held between platinum electrodes 107. The piezoelectric element is 20 mm long, 7 mm wide, and 0.3 mm thick.

In this embodiment, before the print sheet 101 is supplied to the printer from the tray, data (FIG. 9) before holding the print sheet 101 is read in a processing apparatus as an initial state. Reading of the initial state can be omitted. For this data, a negative (lower) side in FIG. 9 is omitted to develop, along a time axis, values of output voltages on a positive side for recording. As a result, a level of a first peak of about 90 mV is observed without the print sheet.

Figure 4:
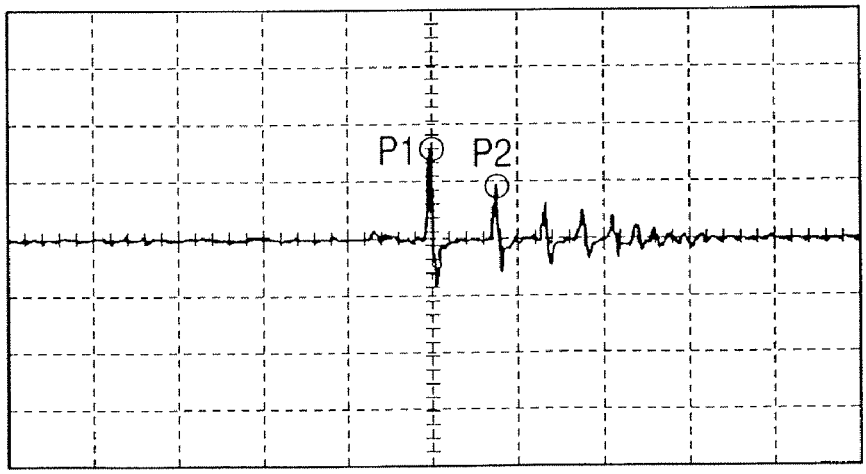
FIG. 4 is a graph of changes with time of an output signal of a piezoelectric element when an impact force is applied to a recording medium.
Figure 5:
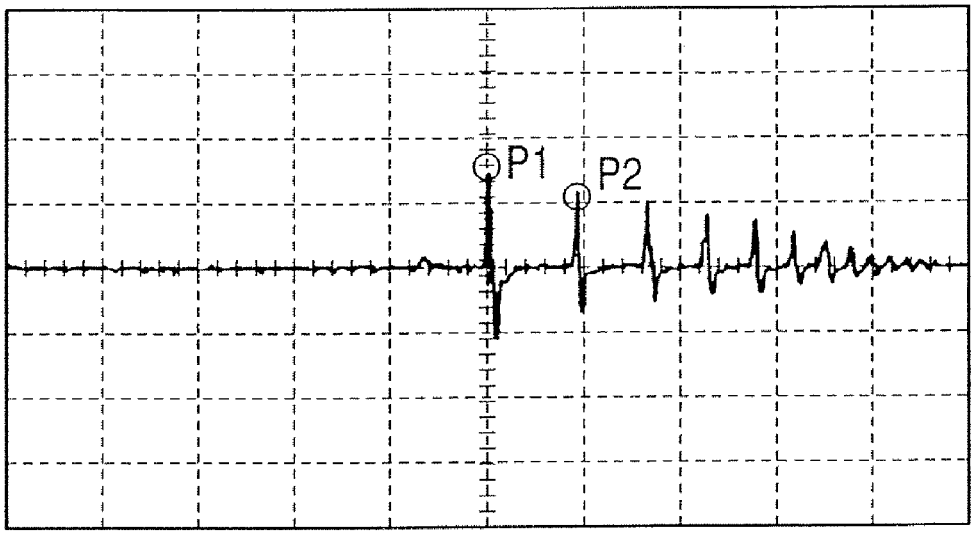
FIG. 5 is a graph of changes with time of an output signal of a piezoelectric element when an impact force is applied to a recording medium.
Figure 6:
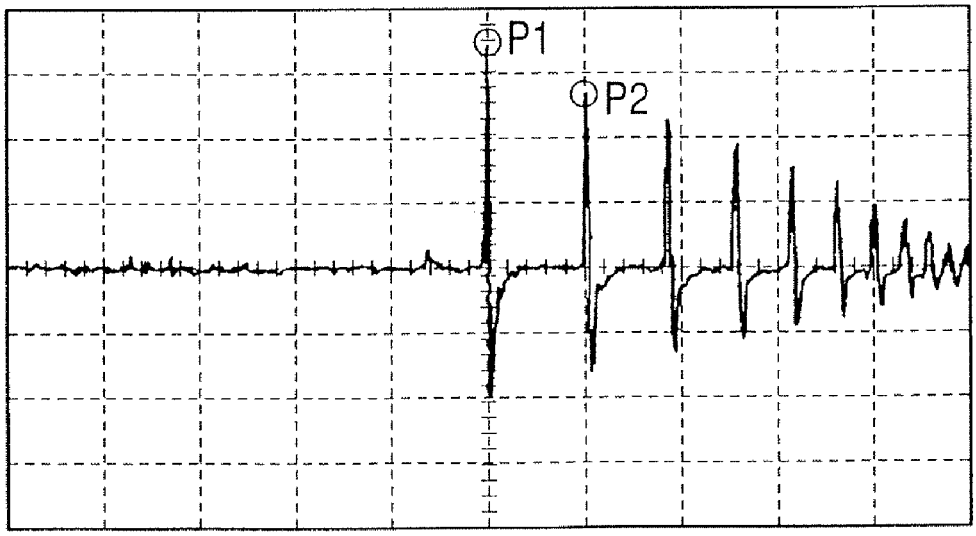
FIG. 6 is a graph of changes with time of an output signal of a piezoelectric element when an impact force is applied to a recording medium.

Then, one print sheet 101 (plain paper) abuts against the leading end guide 103, and the print sheet 101 is held between the holding guide 104 and the pinch roller 102. At this time, the print sheet 101 is pressed against the pinch roller 102 by the holding guide 104 to output a voltage (FIG. 3) from the piezoelectric element 105 placed at a tip of the holding guide 104. The output voltage has a plurality of peaks, and the first peak is 34.3 mV, the second peak is 17.9 mV, and the ratio of the second peak (P2) level to the first peak (P1) level is 0.52. The processing apparatus records these data for determining the double feed. Similar tests are conducted in the double feed states of two, three, or four sheets, and the output data are shown in FIGS. 4, 5 and 6. Specifically, the ratio tends to increase as the number of double fed sheets increases.

In the processing apparatus, the peak levels and attenuation of the voltages in the initial state without any print sheet 101, when one print sheet 101 is held, and when two to four double fed print sheets are held, are previously recorded in a data table, and the table and the output data are compared to determine the double feed of the recording media. Instead of the determination by the peak level and the attenuation as described above, the voltage value at each peak may be compared to determine the double feed. A time interval from the first peak to the second peak may be used to determine the double feed. Time that elapses during attenuation may be calculated from a waveform attenuation curve for comparison and determination. An arithmetical operation apparatus connected to the printer changes the print mode when the double feed detection apparatus of the recording medium detects the double feed. Alternatively, the sheet may be delivered without printing.

In this embodiment, the holding guide is the pinch roller 102, but the structure of the holding guide is not limited, and a separate holding guide may be provided on a pinch roller shaft. An output voltage when the sheet is held is determined as VB, and compared with a value (for example, a peak level) when a voltage in the case of one sheet conveyance is determined as VA, and (VA-VB)/VA may be used.

Embodiment 2

As an embodiment of the invention, a double feed detection apparatus used in an inkjet printer will be described with reference to FIGS. 11 to 16.

Figure 11:
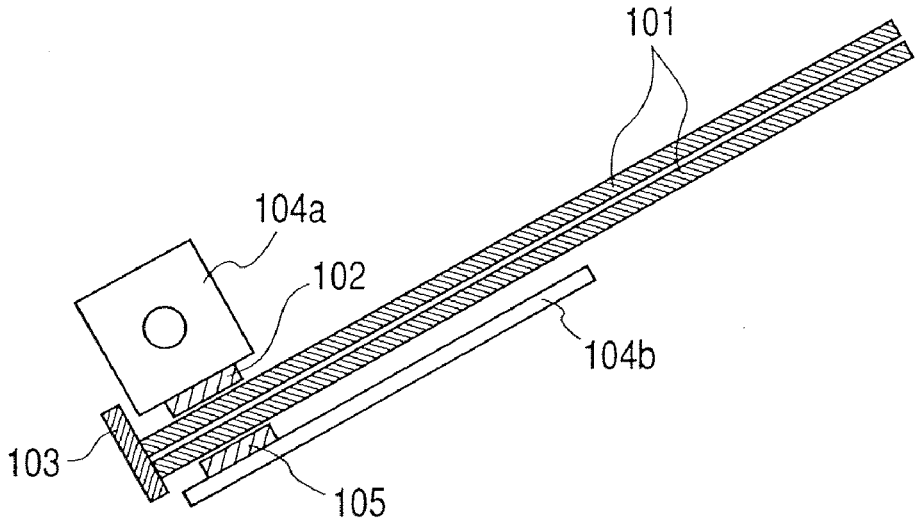
FIG. 11 illustrates an embodiment of the invention.

FIG. 11 schematically shows a sheet conveying mechanism used for aligning leading ends of print sheets inserted from a tray (not shown) in an inkjet printer. Reference numeral 101 denotes a print sheet; 102, a vibration generator placed on one of holding guides; 103, a guide for aligning the leading ends of the print sheets; 104*a*, 104*b*, guides for holding the print sheet; and 105, a receiving sensor. FIG. 11 shows an example in which two print sheets 101 are double fed. PZT (lead zirconate titanate) which is a piezoelectric material is used as the vibration generator 102 and the receiving sensor 105 in this embodiment. The PZT is vertically held between platinum electrodes, and is 20 mm long, 7 mm wide, and 0.3 mm thick.

Figure 12:
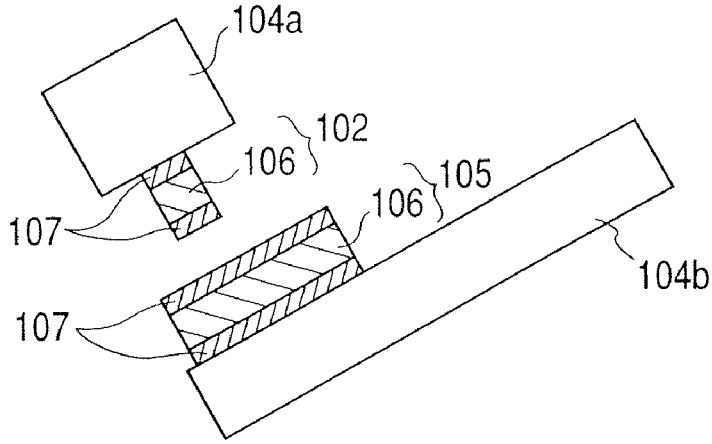
FIG. 12 illustrates an embodiment of the invention.

FIG. 12 shows placement of the vibration generator 102 and the receiving sensor 105. As shown in FIG. 11, the vibration generator and the receiving sensor are placed perpendicularly to each other with the recording medium therebetween, and an overlapping portion has a constant area of 49 $mm^2$. It is desirable that the sensor has an area facing the recording medium larger than that of the vibration generator.

According to this embodiment, in the printer, the print sheet 101 abuts against the leading end guide 103, and the print sheet 101 is held between one holding guide 104*b* and the other holding guide 104*a*. At this time, a sine wave of a resonance frequency (with an amplitude of 25 V and a frequency of 230 KHz) is applied to the vibration generator 102 placed on the holding guide 104*a*, then a sine wave, which is attenuated depending on the double feed (FIGS. 13 to 16), is output from the receiving sensor 105 placed on the holding guide 104*b* with the print sheet 101 therebetween. The processing apparatus records a peak value of the sine wave as data for determining the double feed. The processing apparatus checks the peak value, which is output when the print sheet 101 is held, against the data table to determine the double feed of the print sheets 101.

For printing on many sheets, the above described processing may be performed during one-sheet printing, and the processing apparatus may determine the double feed to send double feed data to the arithmetical operation apparatus in the printer. Generally, one-sheet printing takes three seconds for 20 ppm, which is sufficient for the double feed detection.

In the embodiment, PZT (lead zirconate titanate) is used, but besides, inorganic materials such as PLZT, $BaTiO_3$, PMN—PT, etc. or organic piezoelectric materials may be used as piezoelectric materials. As another embodiment, the holding guide 104*a* may be a pinch roller made of organic piezoelectric element, and the pinch roller may be a vibration generator or a receiving sensor.

Embodiment 3

In this embodiment, a sheet material double feed detection apparatus having a structure shown in FIG. 17 is prepared, and incorporated in an electrophotographic apparatus (a sheet material processing apparatus).

In the apparatus, a sheet material conveying passage A is formed by a pair of left and right conveying guides 10*a*, 10*b*, and an unshown conveying roller (sheet material conveying means) that conveys a recording sheet (a sheet material) P is placed in the sheet material conveying passage A. A hole is provided on a part of the left conveying guide 10*a*, a bracket 8 is placed so as to cover the hole, and a cushioning material 9, a detection sensor (external force detection means) 3 and a displacement member 4 are mounted to the bracket 8 as shown. Specifically, the cushioning material 9 supports the detection sensor 3, the sensor 3 supports the displacement member 4, and the displacement member 4 protrudes into the conveying passage. The amount of protrusion of the displacement member 4 is one-fourth of a width of the conveying passage A (a width at a portion where the displacement member 4 is placed), and any types of recording media (paper or an overhead transparency) conveyed may be brought into contact with the displacement member 4 in the apparatus according to the embodiment. The displacement member 4 is made of a metal member in an arch shape, and its surface that contacts with the recording sheet P is retracted from the opening at the hole of the left conveying guide 10*a*, at an upstream end and a downstream end in the sheet conveying direction; and protrudes toward the right conveying guide 10*b* at the center.

The detection sensor 3 has a structure in which PZT (lead zirconate titanate) as a piezoelectric element is held between silver electrodes. The piezoelectric element is 20 mm long, 5 mm wide, and 0.3 mm thick. A rubber material is used as the cushioning material 9, and the cushioning material 9 is placed between the bracket 8 and the detection sensor 3 to reduce transmission of mechanical vibration from the conveying guide 10*a* to the detection sensor 3, and increase detection accuracy. In FIG. 17, the bracket 8 is fastened to the conveying guide 10*a*, but not limited to this, and as long as appropriate rigidity and fastening accuracy are obtained, the bracket 8 may be mounted to a bracket 211 on the conveying guide 10*b* side;

the brackets 8, 211 may be integrated to be mounted to the conveying guide 10*b*; or the bracket 8 may be mounted to a portion other than the conveying guides 10*a*, 10*b* (for example, a housing or a frame).

On the other hand, external force application means 2 for applying an external force to the recording sheet P is placed in a position opposite the displacement member 4. Specifically, a hole is provided on the right conveying guide 10*b*, and the bracket 211 is placed on the hole. A substantially tubular guide member 215 is mounted to the bracket 211, a rod 217 is placed movably in a horizontal direction in the guide member 215, and a pressing member (an external force application member) 20 is mounted to a tip of the rod 217 (a leading end of the recording sheet). A fringe-like stopper member 214 is provided on the rod 217, and a coil spring 210 is provided in a compressed manner between the stopper member 214 and the guide member 215. On the other hand, a motor 213 is mounted to the bracket 211, a cam 212 is mounted to an output shaft of the motor 213 so that the cam 212 can interfere with a protrusion 218 mounted to the tip of the rod 217. Reference numeral 216 denotes a vent hole for reducing damping by the air in the guide member.

The pressing member 20 hits against the recording sheet P at a predetermined speed by the coil spring 210 and the cam 212 to apply an external force. For example, if the pressing member 20 is unlocked, the external force at that time is determined by interaction between:

"mv", the product of a mass m and a hitting velocity v of the pressing member 20; and the pressing member 20, the recording sheet P and an external force receiving material 4. For determining types of regular sheets as an example, a preferable range is approximately 0.1 gm/s to 10 gm/s. The application of the external force is performed several times for one signal output, preferably with different values of external forces. This allows more accurate detection of the information on the recording sheet.

In the embodiment, the cam 212 is of a two-step type with different steps, and two different external forces can be applied in one rotation by the motor 213. Specifically, a larger cam 212 interferes with the protrusion 218 to move the pressing member 20 to the right, the pressing member 20 hits against the recording sheet P by a spring force of the coil spring 210 at the moment of unlocking of the cam 212, a smaller cam 212 interferes with the protrusion 218 to move the pressing member 20 to the right, and the pressing member 20 hits against the recording sheet P by the spring force of the coil spring 210 at the moment of unlocking of the cam 212. In this case, the larger cam 212 and the smaller cam 212 afford different compression distances of the coil spring 210, and thus the external forces applied to the recording sheet P are different.

It is also preferable that another cam is attached to a drive shaft of the cam 212 (that is, a rotation shaft of the motor), and the displacement member or an auxiliary displacement member is displaced as the external force is applied.

In the embodiment, the displacement member 4 is placed in a position opposite the pressing member 20 so that the displacement member 4 receives the external force.

Embodiment 4

Figure 19:
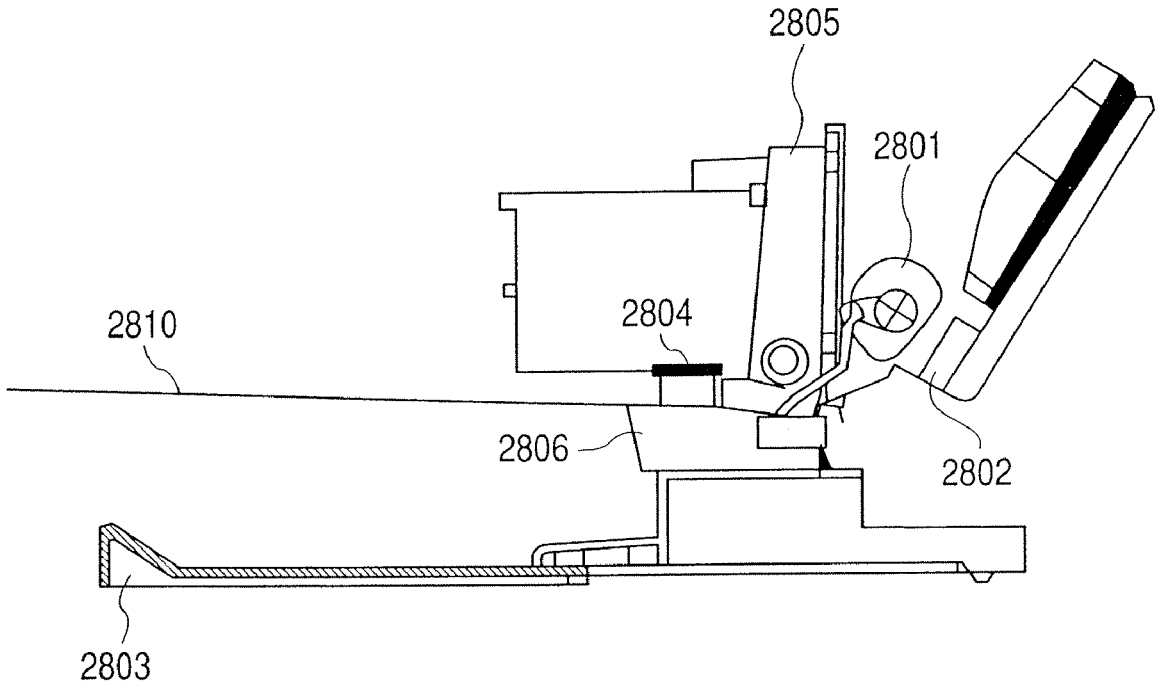
FIG. 19 illustrates an embodiment of the invention.

FIG. 19 schematically shows a section of, for example, an inkjet printer. Reference numeral 2801 denotes a sheet feed roller; 2802, detection means; 2803, a sheet delivery tray; 2804, a print head; 2805, a circuit; 2806, a conveying mechanism; and 2810, a sheet material.

The image forming apparatus according to the invention may include, for example, a signal output apparatus as described above, an image forming means for discharging ink onto the sheet material to form an image, and sheet delivery control means for determining the status of the double feed based on a signal from the signal output apparatus to control sheet delivery.

The image forming apparatus according to the invention may alternatively include, for example, a signal output apparatus as described above, an image forming means for forming a toner image on the sheet material, fixing means for heating and pressurizing the toner image on the sheet material to fix on the sheet material, and sheet delivery control means for determining the status of the double feed based on a signal from the signal output apparatus to control sheet delivery.

The image forming apparatus according to the invention may still alternatively include, for example, a signal output apparatus as described above, an image forming means for forming an image on the sheet material by a thermal head, and warning means for determining the status of the double feed based on a signal from the signal output apparatus to warn a user about double feed.

When the invention is applied to a system including a computer connected to the image forming apparatus inside or outside thereof, for example, a first step of making contact with the sheet material and applying vibration, and a second step of outputting a signal from a detection unit due to the first step are performed in the image forming apparatus, and the status of the double feed is determined, based on the signal, by the computer connected to the image forming apparatus inside or outside thereof.

What is claimed is:

1. A double feed detection apparatus comprising:

an external force application member for applying an impact or vibration external force to a sheet material; and a detector for detecting a force obtained from the sheet material when said external force application member applies the external force to the sheet material, wherein the external force is applied by bringing the external force application member into contact with the sheet material from a non-contact state between the external force application member and the sheet material and wherein the application member and the detector oppose each other with the sheet therebetween.

2. A double feed detection apparatus comprising:

an external force application member for applying an impact or vibration external force to a sheet material by bringing the external force application member into contact with the sheet material; and a detector for detecting a force obtained from the sheet material by bringing the detector into contact with the sheet material when said external force application member applies the external force to the sheet material, wherein the external force is applied in a state where the sheet material is standing still and wherein the application member and the detector oppose each other with the sheet therebetween.

3. A double feed detection apparatus comprising:

an external force application member for applying an impact or vibration external force to a sheet material by bringing the external force application member into contact with the sheet material; and a detector for detecting a force obtained from the sheet material by bringing the detector into contact with the sheet material when said external force application member applies the external force to the sheet material, wherein double feed is determined from frequency components of vibration detected by the detector depending on the application of the external force and wherein the application member and the detector oppose each other with the sheet therebetween.

* * * * *

UNITED STATES PATENT AND TRADEMARK OFFICE

CERTIFICATE OF CORRECTION

PATENT NO. : 7,296,795 B2
APPLICATION NO. : 11/536847
DATED : November 20, 2007
INVENTOR(S) : Kawasaki It is certified that error appears in the above-identified patent and that said Letters Patent is hereby corrected as shown below:

ON THE TITLE PAGE:
At Item (56), References Cited, U.S. Patent Documents, "4,864,851 A 9/1989 Haughton" should read --4,864,851 A 9/1989 Houghton--.

COLUMN 2:
Line 35, "apply" should read --applies--.

COLUMN 3:
Line 39, "an" should be deleted.
Line 41, "an" should be deleted.

COLUMN 7:
Line 60, "include" should read --includes--.

COLUMN 8:
Line 48, "an" should read --a--.

COLUMN 9:
Line 22, "preciously" should read --previously--.

COLUMN 12:
Line 37, "stropped" should read --stopped--.
Line 50, "state," should read --state, and--.

Signed and Sealed this

Twenty-fourth Day of June, 2008

JON W. DUDAS
*Director of the United States Patent and Trademark Office*